US005208638A

United States Patent [19]

Bujese et al.

[11] Patent Number: 5,208,638

[45] Date of Patent: May 4, 1993

[54] INTERMEDIATE TRANSFER SURFACE AND METHOD OF COLOR PRINTING

[75] Inventors: David P. Bujese; Peter E. Materazzi, both of Southington, Conn.

[73] Assignee: Olin Corporation, Cheshire, Conn.

[21] Appl. No.: 656,400

[22] Filed: Feb. 19, 1991

Related U.S. Application Data

[63] Continuation-in-part of Ser. No. 546,287, Jun. 29, 1990, Pat. No. 5,132,743.

[51] Int. Cl.[5] ..... G03G 15/16

[52] U.S. Cl. ..... 355/274; 355/271; 355/273

[58] Field of Search ..... 355/274, 275, 271, 277, 355/273, 272; 430/126, 48; 428/421, 244, 283, 323, 422, 408; 524/862; 174/255, 256, 257

[56] References Cited

U.S. PATENT DOCUMENTS

| | | | |
|---|---|---|---|
| 3,591,276 | 7/1971 | Byrne . | |
| 3,653,944 | 4/1972 | Ehrhardt et al. | 117/36.1 |
| 3,893,761 | 7/1975 | Buchan et al. . | |
| 3,923,392 | 12/1975 | Buchan et al. . | |
| 4,095,886 | 6/1978 | Koeleman et al. . | |
| 4,518,976 | 5/1985 | Tarumi et al. | 346/153.1 |
| 4,588,674 | 5/1986 | Stewart et al. | 430/273 |
| 4,604,424 | 8/1986 | Cole et al. | 524/862 |
| 4,690,539 | 9/1987 | Radulski et al. | 118/645 X |
| 4,796,048 | 1/1989 | Bean . | |
| 4,879,184 | 11/1989 | Bujese et al. | 430/126 |
| 4,894,686 | 1/1990 | Bujese | 355/271 |
| 4,984,025 | 1/1991 | Landa et al. | 355/274 |
| 5,055,444 | 10/1991 | Kaszczuk | 563/227 |
| 5,072,671 | 12/1991 | Schneider et al. | 101/467 |

FOREIGN PATENT DOCUMENTS

| | | |
|---|---|---|
| 56-1658173 | 12/1981 | Japan . |
| 59-77467 | 5/1984 | Japan . |
| 59-91465 | 5/1984 | Japan . |
| 2-10653 | 4/1990 | Japan . |

OTHER PUBLICATIONS

Article entitled "Fluorosilicone and Conductive Silicones" from Rubber World Magazine, vol. 200, No. 3, Jun. 1989.

*Primary Examiner*—A. T. Grimley
*Assistant Examiner*—Thu A. Dang
*Attorney, Agent, or Firm*—William A. Simons

[57] ABSTRACT

An improved intermediate transfer surface employing a conductive fluoropolymer material and preferably a conductive material dispersed in a fluoroelastomer layer is provided for use in electrostatic color image transfers. The intermediate fluoropolymer transfer surface is heat and solvent resistant and retains its electrical conductivity upon exposure to both heat and solvent, while exhibiting excellent thermal release characteristics for contact transfers of dried liquid color toners. A method of xeroprinting a color image onto a receiving substrate using a first electrostatic transfer through a liquid-filled gap to the conductive intermediate transfer surface and then a second contact transfer from the conductive intermediate fluoropolymer transfer surface to a final receiving surface is also disclosed.

32 Claims, 2 Drawing Sheets

INTERMEDIATE TRANSFER SURFACE AND METHOD OF COLOR PRINTING

This application is a continuation-in-part of U.S. Ser. No. 07/546,287 filed June 29, 1990, now U.S. Pat. No. 5,132,743 and assigned to the assignee of the present invention.

BACKGROUND OF THE INVENTION

This invention relates generally to electrostatic image transfers and, more specifically, to a conductive intermediate transfer surface and the method of employing that conductive intermediate transfer surface in a color printing process employing a liquid toner.

Elastomeric transfer surfaces have been used in electrophotographic copiers. Early efforts employed an electrophotographic copier with a rotatable photoconductive drum that transferred a dry toner developed image to a silicone elastomer transfer belt that was part of a transfer and fusing system. This was employed in combination with a radiant fuser and paper transport system to provide a high speed copier.

Another related system employed an intermediate transfer drum which received the dry toner developed image from a rotatable drum whose surface was coated with a photoconductor. The intermediate transfer drum utilized a support material such as aluminum and had its surface coated with a suitable conductive or non-conductive silicone rubber having low specific heat that was applied in a thin layer. These intermediate transfer surfaces were described as having smooth surfaces of low surface free energy and a hardness of from 3 to 70 durometers.

Compositions designed specifically for use as thermally conductive elastomers in a fuser roller for electrostatic copying machines were developed by the Dow Corning Corporation. The compositions were thermally conductive polyorganosiloxane elastomers that possessed high abrasion resistance, low durometer hardness and high heat conductivity.

Xerox Corporation developed an elastomeric intermediate transfer surface that was either formed into a belt or was formed on the surface of a drum as part of a process to transfer a dry powder xerographic image from a photoconductive surface to a final support surface, such as paper. Heat and pressure were utilized to transfer the developed powder image from the intermediate elastomeric transfer surface to the paper.

All of these prior approaches utilized a dry powder toner that was contact or pressure transferred from the photoconductive surface to the intermediate transfer surface and then to the final receiving surface. These approaches were susceptible to image distortion during the transfer from the photoconductor because of the pressure or contact involved in the transfer step. They also transferred less than 100% of the toner particles from the intermediate transfer surface to the final receiving surface. None of these approaches attempted to use a liquid toner to improve the resolution of the transferred image. The use of liquid toners, because of the suspension of the toner particles in non-polar insulating solvents that are usually mixtures of branched aliphatic hydrocarbons, will cause a conductive silicone-based elastomer to swell upon exposure and become very dielectric. These results affect the quality of the transferred image and reduce the ability to electrostatically transfer the charged toner particles. The consistency of the intermediate transfer surface upon prolonged exposure to these solvents will change to that of a gel.

Subsequently, a system employing a liquid toner has been developed to transfer a liquid developed image from a photoconductor to a copy sheet via an intermediate transfer surface from which the carrier liquid is roller squeezed or removed by infrared heating to be substantially free of carrier liquid prior to the final image transfer to the copy sheet. However, this does not remove all of the solvent from the copy sheet, since solvent is still present in the image areas in order to achieve electrostatic image transfer. The intermediate transfer surface is formed from a material described as non-absorbing and resilient, but transfer from the photoconductor to the intermediate transfer surface is effected by contact pressure and the intermediate transfer surface is deformed by contact with the toner particles in the image areas to achieve the transfer from the photoconductor covered drum to the intermediate transfer surface. This negatively affects the quality of the transferred image as described previously.

These problems are solved in the process of the present invention and in the design of the intermediate transfer surface by providing a conductive intermediate transfer surface formed of conductive fluoroelastomer material that can reversibly deform and is resistant to solvent and heat. The conductive intermediate transfer surface which can also be a conductive fluoropolymer, is used in a two step transfer process that initially electrostatically transfers a liquid toner developed image from a master surface through a liquid-filled gap to the intermediate transfer surface and then by contact transfer to the final receiving surface, such as paper. No carrier liquid needs to be transferred to the final receiving surface.

SUMMARY OF THE INVENTION

It is an object of the present invention to provide an improved intermediate transfer surface for use in electrostatic image transfers employing liquid toners.

It is another object of the present invention to provide a method of color copying or printing in which substantially none of the carrier liquid in which the toner particles are dispersed is carried to the final receiving surface.

It is a feature of the present invention that the improved intermediate transfer surface is a conductive fluoropolymer material, and preferably is a fluoroelastomer such as a fluorosilicone or fluorocarbon elastomer, that is resistant to typical non-polar insulating branched aliphatic hydrocarbon solvents used as the carrier liquid for liquid toner particles.

It is another feature of the present invention that the conductive fluoropolymer, and preferably the fluoroelastomer material, used as the improved intermediate transfer surface possesses excellent surface release characteristics for the toner.

It is still another feature of the present invention that the intermediate transfer surface is made conductive by the inclusion of highly structured conductive carbon black particles, graphite, metal fibers or metal powder particles.

It is yet another feature of the present invention that the method of employing the improved intermediate transfer surface in a copying or printing process utilizes a first electrostatic transfer from a master to the intermediate transfer surface across a liquid-filled gap and a second contact transfer from the improved intermediate transfer surface to the final receiving surface.

It is an advantage of the present invention that no carrier liquid is transferred to the final receiving surface from the improved intermediate transfer surface.

It is another advantage of the present invention that substantially 100% toner release from the intermediate transfer surface to the final receiving surface is achieved due to the toner release characteristics of the improved intermediate transfer surface.

It is still another advantage of the present invention that the improved intermediate transfer surface experiences only controlled swelling upon exposure to the carrier liquid in which the liquid toner particles are dispersed It is yet another advantage of the present invention that the improved intermediate transfer surface is a high performance fluoropolymer or fluoroelastomer with high chemical and thermal resistance.

These and other objects, features and advantages are obtained by the use of the improved intermediate transfer surface formed from a conductive fluoropolymer material, preferably a fluoroelastomer such as fluorosilicone or fluorocarbon, in an electrostatic image transfer process that employs a first electrostatic image transfer from a master to the improved intermediate transfer surface across a liquid-filled gap and a second contact transfer from the improved intermediate transfer surface to the final receiving surface without the transfer to the final receiving surface of any of the carrier liquid from the liquid toner. Substantially 100% of the toner particles are transferred from the improved intermediate transfer surface to the final receiving surface.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
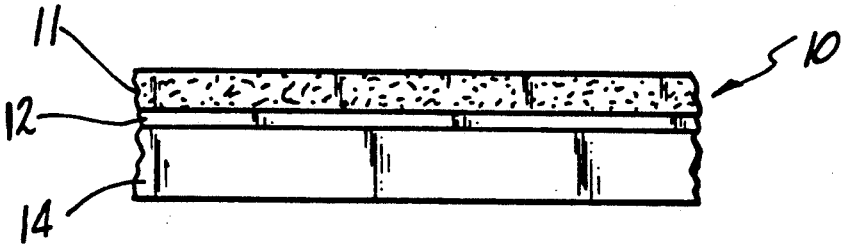
FIG. 1 is a side elevational view of a section of the improved conductive intermediate transfer surface showing the laminate structure.

FIG. 1 shows in side elevational view the conductive intermediate transfer surface, indicated generally by the numeral 10. Intermediate transfer surface 10 is comprised of a conductive material 11, preferably a conductive fluoropolymer or fluoroelastomer that is adhesively fastened to a thinner conductive metal layer 12, which is in turn appropriately fastened to an underlying supporting dielectric layer 14, such as heat stabilized polyester, polysulfone, polyimide or polyethylene terephthalate.

The conductive fluoropolymer or fluoroelastomer layer 11 ranges in thickness from about 0.5 to about 50 mils, preferably from about 2 to about 10 mils and more preferably about 5 mils thickness. The volume resistivity of the layer 11 should be from about $10^{-1}$ to about $10^{6}$ ohm-centimeters. The fluoropolymer or fluoroelastomer material is made conductive by the addition of conductive carbon black particles, metal fibers, graphite or powder particles of less than about 5 microns down to sub-micron size to ensure good conductive linking throughout the material and for good distribution during compounding. For example, metal powders are typically less than 5 microns in size, silver-filled conductive adhesives have about 2 to about 3 micron size silver particles, graphite particles can range from about 1 to about 5 microns, and carbon black particles are typically submicron in size.

The preparation of especially the conductive fluoroelastomer layer 11 will be described in greater detail hereafter, but it must be understood that the contact surface of this layer 11, regardless of the particular material used, must be very smooth to ensure good toner release during transfer to the final receiving substrate, such as paper. Other potentially suitable materials such as metal fibers or powder particles include aluminum, silver, or graphite, as long as they are less than the aforementioned about 5 micron size and are suitably sized so as not to affect the surface release characteristics of the conductive fluoropolymer or fluoroelastomer layer 11.

The conductive metal layer 12 can range in thickness from 0.1 to about 1 mils and can include any appropriate metal or conductive material. It is through this conductive metal layer 12 that the transfer voltage is applied to establish an electrostatic field between the surface of the fluoroelastomer and the electrostatically imagable surface, described in further detail hereinafter, or its corresponding ground plane. This causes oppositely charged toner particles to be attracted through the liquid-filled gap to the surface of the conductive fluoroelastomer layer 11 via the conductive dispersion in the layer 11.

The dielectric layer 14 can range in size from about 3 to about 15 mils in thickness and must be heat stabilized so that the entire laminated conductive intermediate transfer surface 10 is a material that is dimensionally stable under heat and tension.

Figure 2:
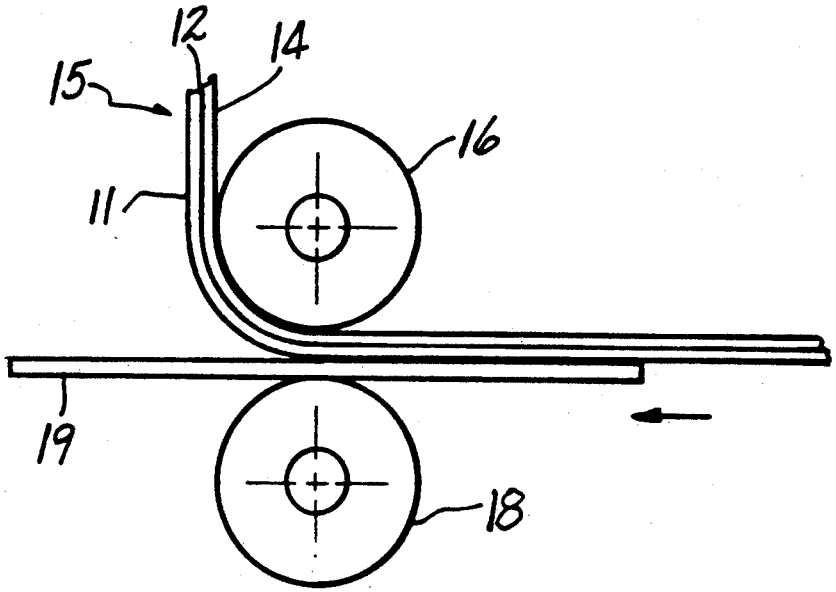
FIG. 2 is a diagrammatic illustration of one potential embodiment of the improved conductive intermediate transfer surface employed in belt form making a transfer to a final receiving surface, such as paper.

FIG. 2 is a diagrammatical illustration of the use of the intermediate transfer surface 10 in the form of a belt 15 that is kept under tension and is passed between two opposing fuser rollers 16 and 18 and into direct contact with a receiving paper substrate 19. When used in combination with fusing rollers 16 and 18 in a contact transfer to paper, or other appropriate receiving substrate, the thickness of the conductive fluoropolymer or fluoroelastomer layer 11 should be as small as possible and where a fluoroelastomer is used the durometer preferably should be 60 or higher on the Shore A scale. The durometer of the fusing roller should be as soft as about 30 to about 50 durometer to ensure that the fusing roller surfaces will deform, rather than the conductive fluoroelastomer surface layer 11. The contact transfer illustrated in FIG. 2 requires that the fluoropolymer or fluoroelastomer belt 15 be subjected to both heat and high pressure by the fusing rollers 16 and 18 to ensure that the toner particles are fused to the receiving paper 19.

The classes of high performance conductive fluoroelastomers utilizable include silver-filled elastomers with volume resistivities of greater than about $10^{-4}$ ohm-centimeters. Other suitable fluoropolymer materials include metallic filled materials with volume resistivities greater than about $10^{-1}$ ohm-centimeters and non-metallic, carbon or graphite filled materials, such as polytetrafluoroethylene sold under the tradename TEFLON, having greater than about 0.5 ohm-centimeter volume resistivities. Other suitable fluorocarbon plastics include polyvinyl fluoride and polyvinylidene fluoride, both available commercially from the E. I. DuPont de Nemours & Company under the tradenames TEDLAR and KYNAR respectively.

Fluorocarbon and fluorosilicone elastomers have good thermal resistance and use fluorine as a replacement for hydrogen to achieve enhanced chemical and thermal resistance. Representative fluorocarbon polymers that may be successfully employed include copolymers of tetrafluoroethylene and propylene such as that sold under the tradename AFLAS by 3M Corporation; copolymers of hexafluoropropylene and vinylidene fluoride such as that sold under the tradename FLUOREL by 3M Corporation; and VITON fluoroelastomers sold by E. I. DuPont de Nemours and Company that include dipolymers of hexafluoropropylene and vinylidene fluoride; and terpolymers of hexafluoropropylene, vinylidene fluoride and tetrafluoroethylene. The dipolymers and terpolymers of hexafluoropropylene can have varying amounts of fluorine, ranging from about 66 percent by weight to about 70 percent by weight of polymer. Suitable perfluoroelastomers, such as that sold by E. I. DuPont de Nemours & Company under the tradename KALREZ, may also be employed. Additionally, these fluorocarbons may be cured with peroxide to enhance their low temperature flexibility if desired.

The selection of a fluoropolymer or a fluoroelastomer as the conductive material ensures that the intermediate transfer surface will be resistant to branched aliphatic hydrocarbons, such as those used as non-polar insulating solvents sold under the tradename ISOPAR by Exxon Chemical Corporation. Use of a conductive silicone material for the intermediate transfer surface 10 would not be appropriate because of the amount of swelling that occurs upon contact with the ISOPAR solvent. An additional disadvantage of a conductive silicone material is that upon exposure to ISOPAR solvent the material becomes extremely resistive. This would prevent utilization of the transfer of the toner particles across a liquid-filled gap as the preferred method in the instant invention of transferring from a master to the intermediate transfer surface. An advantage of the conductive fluoroelastomer material lies in the fact that the conductivity is not affected to the same degree, or is affected to a lesser extent, upon exposure to ISOPAR solvent. This facilitates transfer of a high percentage of the toner particles on the developed master image across a liquid-filled gap to the intermediate transfer surface.

Figure 3:
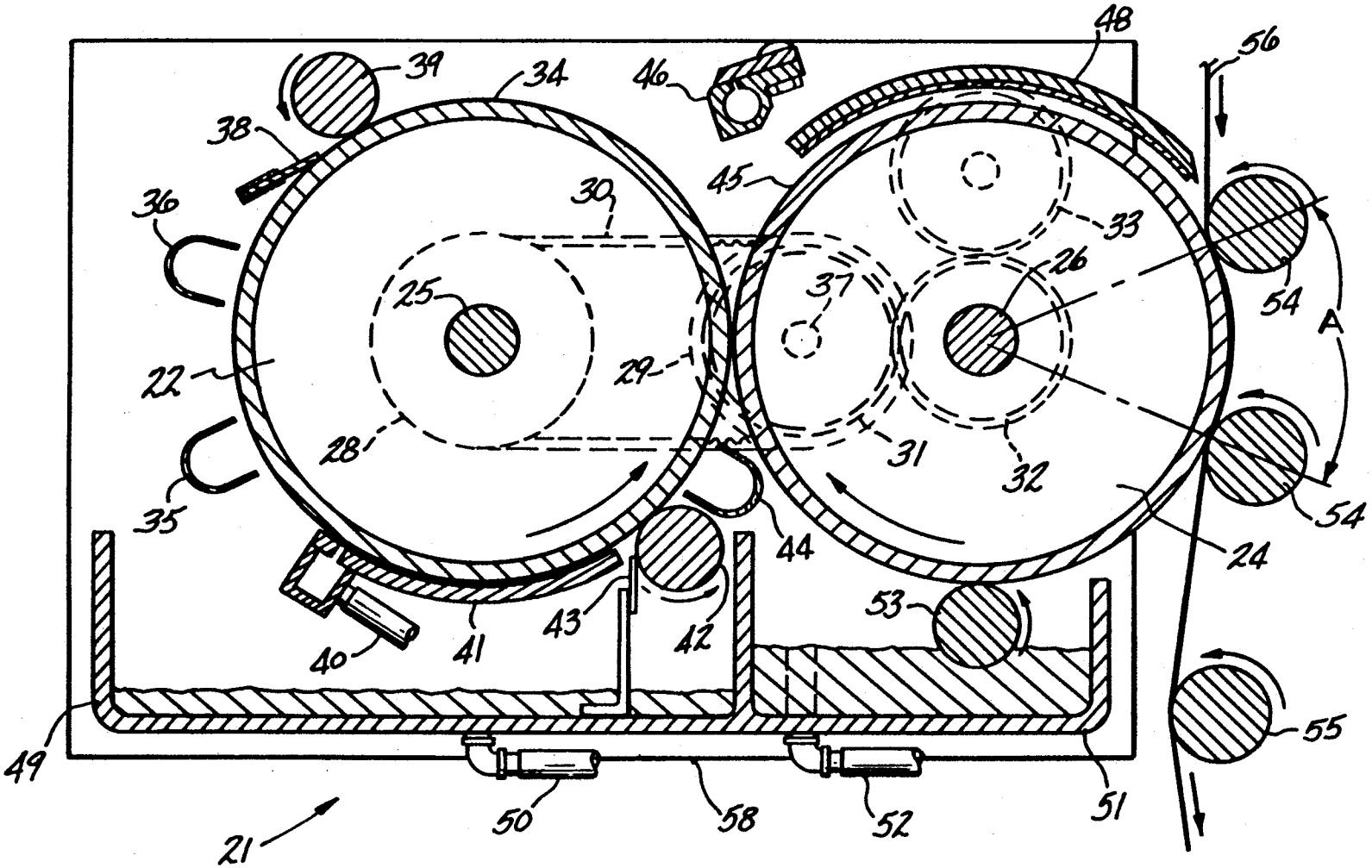
FIG. 3 is a side elevational view of a second potential embodiment of the improved conductive intermediate transfer surface employed as a surface covering on a drum making a transfer to a paper final receiving surface as part of a color printer module.

FIG. 3 discloses an alternative embodiment employing the conductive intermediate transfer surface 10 applied to a supporting drum 24. In this embodiment a color printer module is indicated generally by the numeral 21 and consists of a master drum 22, upon which a master material 34 is mounted, and the drum 24. A finite gap of between about 1 mil and about 20 mils is maintained between the drums 22 and 24 and is filled with a liquid formed at least partially of a non-polar insulating solvent and the toner particles which are suspended in an carrier liquid, which can also be the appropriate ISOPAR solvent, such as that sold under the tradename ISOPAR G or ISOPAR H. These solvents are generally mixtures of $C_9$–$C_{11}$ or $C_9$–$C_{12}$ branched aliphatic hydrocarbons having an electrical resistivity preferably on the order of at least about $10^9$ ohm-centimeters and a dielectric constant preferably less than about $3\frac{1}{2}$.

As seen in FIG. 3, a housing 58 surrounds and contains the color printer module 21. Module 21 can be one of a plurality used in a multi-color printer. The master drum 22 is mounted about a master drum shaft 25 and intermediate transfer surface drum 24 is rotatably mounted about shaft 26. A main drive gear 33 that is driven by the printer main drive shaft mechanism (not shown) is slidably intermeshed with gear 32 that is fastened to and mounted on intermediate transfer surface drum 24 and mounted about shaft 26. Gear 32 meshingly interconnects with a sprocket 29 that is connected to master drum drive sprocket 28 via timing belt 30. The rotation of the main drive gear 33 turns the intermeshing gear 32 that in turn drives the intermediate transfer surface drum gear 31 which rotates about shaft 37 causing drum sprocket 29 to rotate. Timing belt 30 is thereby driven by the rotation of drum sprocket 29 and drives master drum drive sprocket 28 and the master drum 22 with the master on its surface.

Although described as a master, the master 34 can be any suitable electrostatically imagable surface, including a photoreceptor with an additional exposure unit. This can include a photoconductor, such as a cadmium sulfide surface with a MYLAR polyester film or a polystyrene or a polyethylene overcoating, a selenium photoconductor drum, or suitable organic photoconductors such as carbazole and carbazole derivatives, polyvinyl carbazole and anthracene. If a master with a permanent latent image is desired, the surface can be a zinc oxide or organic photoconductor developed with a toner which is fused onto the master, or a dry film or liquid photoresist that is appropriately exposed.

Master drum 22 overlies a toner tray 49 that is filled with a liquid toner. Liquid toner is fed through a toner feed line 40 (partially shown) to a toner development electrode 41 which places the liquid toner particles and the carrier solvent on the surface of the master 34. The charge corona 35 applies a charge to the surface of the master to attract particles to the imaged area. A discharge corona 36 is provided to remove the charge from the master prior to recharging with the charge corona 35. A cleaning wiper blade 38 is provided in conjunction with a reverse cleaning roller 39 to remove any excess toner from the master 34 after transfer has occurred across the liquid-filled gap between the master 34 and the intermediate transfer surface 45. Once the master 34 has been cleaned, discharged, charged and toned to develop the latent image, a reverse roller 42, working in conjunction with reverse roller wiper 43 removes excess toner and passes the toned image to the depressant corona 44. Master drum 22 then rotates the toned image into the liquid-filled gap to accomplish the first electrostatic transfer to transfer the toner particles to the intermediate conductive transfer surface 45 that is applied about the drum 24.

An air knife 46 or other appropriate drying mechanism dries the transferred image on the intermediate conductive transfer surface 45 to remove substantially all of the solvent or carrier liquid surrounding the toner image. The transferred image is then rotated under a fuser 48 to dry the solvent around the toner particles and melt the toner particles on the intermediate transfer surface.

Transfer rollers 54 are provided to effect a contact transfer from the intermediate transfer surface 45 to the paper receiving surface 56 across a transfer window indicated by the numeral A between the two rollers 54. Transfer rollers 54 can employ internal heating elements to facilitate transferring to the paper. Alternately, heat can be provided in conjunction with the heating elements in transfer rollers 54 or solely within the drum 24 to facilitate 100% release of the developed image from the surface of the master 34 to the paper 56. Once the transfer has been effected, the drum continues to rotate and the intermediate transfer surface 45 is wicked or wetted with a wicking roller 53 that applies a non-polar insulating solvent from the solvent supply tray 51. In combination with the solvent applied by the wicking roller 53 to the intermediate transfer surface 45 and the liquid toner applied via the toner development electrode 41 to the master 34, a sufficiently deep medium of solvent is created to form a liquid-filled gap between the drums 22 and 24 with their master 34 and intermediate transfer surface 45. This gap between the two drums is maintained by the position adjustment of the drums. The transfer is effected via the application of an electric field created by a charging unit (not shown) connected to the metal drum 24 about the external surface of which is mounted the intermediate transfer surface 45. The transfer across the liquid-filled gap is accomplished as described in U.S. Pat. No. 4,879,184 issued Nov. 7, 1989 and assigned to the assignee of the present invention.

The non-polar insulating solvent is supplied to the solvent tray 51 via solvent supply line 52. Similarly, the liquid toner is supplied to the toner development tray 49 via the toner supply line 50. Excess toner that is removed via the reverse roller 42 and the roller wiper 43 is collected within the toner development tray 49.

Where the conductive fluoroelastomer layer 11 is to be a fluorosilicone layer, it may be prepared by utilizing a two component fluorosilicone rubber dispersion, such as Dow Corning X5-8749 sealant coating, or other suitable dispersion coatings. The Dow Corning X5-8749 sealant coating is a two part fluorosilicone compound that employs a conductive dispersion therein and is prepared as described hereinafter.

The part A component was supplied at 100% solids and was not modified for use. The part B component was modified by having dispersed therein a conductive carbon black. Other suitable conductive material may also be employed. A typical blending of the part B component includes the following:

TABLE 1

| | Weight (gms) |
|---|---|
| Ketjen black (Akzo Chemical) EC300 | 9.6 |
| DOW X5-8749 Part B | 110.4 |
| Methylethyl ketone solvent | 380.0 |
| Total | 500.0 |
| | 24% Solids in Methylethyl ketone |

This part B mixture was added to a high speed disperser and mixed for about 5 minutes to ensure a fine homogeneous dispersion of the carbon black. To prepare the intermediate conductive fluorosilicone layer 11, one part of part A and 4.5 parts of the modified part B of the two component mixture were mixed together, for example, in a high speed disperser to form a homogenous mixture that was applied to the conductive metal layer substrate 12. The homogeneous mixture can contain, when compared with the weight of the conductive fluorosilicone elastomer, from about ½ to about 50%, preferably about 2 to about 15% and more preferably about 3 to about 6% by weight conductive carbon expressed as a percent of total nonvolatile solids.

Application of the activated blended homogeneous mixture was by pouring onto the substrate 12 and smoothing with a knife to form a coating having a thickness of about 50 mils. The intermediate conductive fluorosilicone elastomer layer was dried by being run through a heater at a temperature of about 107° C. for an appropriate time to allow the layer to drive off any residual solvent. It was then cured at room temperature of about 25° C. for at least 24 hours, but preferably 7 days. The final dried and cured conductive fluorosilicone elastomer layer had a thickness of about 5 mils. This produced a uniform coating within about a ½ mil tolerance. This tolerance is essential since the use of contact transfer from the intermediate conductive surface to the final receiving surface requires there be no deformations or imperfections in the transfer surface where toner particles can become trapped and not be released. Contact transfers of liquid toner developed images from the intermediate conductive fluorosilicone elastomer transfer surface with the layer 11 prepared as described above have repeatedly achieved 100% toner transfer from the surface to a paper final receiving substrate.

This ½ mil tolerance also is important to maintain a uniform and non-interfering liquid-filled transfer gap during the electrostatic transfer between the electrostatically imagable surface or master 34 and the conductive intermediate transfer surface 45.

The structure of the carbon black employed as the conductive dispersion or filler in the conductive fluoroelastomer affects its electrical conductivity. Highly structured carbon black provides recticulate chains of carbon particles which form almost continuous paths through a medium. The chain or grape-like aggregates formed by the carbon black provide the conductivity. The particle size of an appropriate carbon black, measured by an electron microscope, can vary as an arithmetic mean of the particle diameter from about 20 to about 30 millimicrons, depending on the source of the carbon black.

The conductive metal layer can be prepared for receiving the conductive fluoroelastomer layer 11 by application of a primer, such as a Dow Corning 3-6060 prime coat that is air dried after the surface has been thoroughly cleaned and degreased by using a chlorinated solvent on a slightly abrasive pad or course lint free cloth. The surface is then appropriately rinsed of all cleaning agents with methylethyl ketone or acetone. After the rinse agent has dried, a thin coating of the prime coat is applied by dipping, brushing or spraying.

Where the fluoroelastomer layer is to be a fluorocarbon layer, it may be prepared similarly as described above with the use of, for example, a 0.005 inch thick piece of polyether sulfone film that has a thin metallized layer of aluminum on one surface. The metallized surface has spray coated thereon about a 0.001 inch thick layer of conductive fluoroelastomer sold under the tradename of VITON by the E. I. DuPont de Nemours & Company. The fluoroelastomer was formulated by Belting Industries, Inc. of Kenilworth, N.J. with conductive carbon black of the aforedescribed composition added to it. The compound was strained through a cheesecloth filter before spraying to remove any agglomerates that might impair the spraying operation or affect the smoothness of the sprayed surface.

A transfer of 100% of the applied toner to the conductive fluoroelastomer's surface was achieved as described hereafter. A 2 inch by 5 inch strip of the polyether sulfone, aluminum and fluoroelastomer sheet was fastened to the conductively coated side of a transparent Nesa glass plate which is glass coated with tin oxide on one side. A conductive contact surface was established between the fluoroelastomer intermediate transfer surface and the glass plate. An identical transparent Nesa glass plate was then immersed, along with the first glass plate that had the fluoroelastomer material attached to it, in a solution of negative liquid toner in a beaker in a support stand so that the two glass plates were about ½ inch apart. The toner was of the composition described in U.S. Ser. No. 07/498,785 filed Mar. 26, 1990 assigned to the assignee of the present invention and specifically incorporated by reference herein in pertinent part. A positive charge of about 1000 volts was applied across the plates for about 20 seconds, causing the toner particles to be deposited on the fluoroelastomer surface. The fluoroelastomer coated strip was removed from the beaker and air dried. An 8½"×11" piece of standard magazine print quality paper was then placed on top of the toner coated fluoroelastomer surface and the two surfaces were run through a fuser roller at about 135 degrees Centigrade. The paper was 50 pound weight web gloss grade available from the Westvaco Corporation. 100% of the toner was transferred and fused to the sheet of paper from the fluoroelastomer surface.

In operation, a suitable latent electrostatic charge is formed on a photoconductor, photopolymer, or other suitable electrostatically imagable surface material. The charged image is developed with toner particles and they are transferred across a liquid-filled gap to a conductive fluoroelastomer or other suitable conductive intermediate transfer surface. The transferred image is dried on the intermediate transfer surface 10 and any excess components or insulating solvent is recycled to the appropriate solvent collecting point or tray 51. This procedure can be repeated if multiple colors are to be built up on the intermediate transfer surface 10. Once the desired number of colors are applied and dried on the intermediate transfer surface 10, the transfer surface 10 is heated, such as with a reflective lamp or other appropriate means. The thus heated color image is then contact transferred to the receiving substrate or paper.

Where a printer is employed, each color is applied separately and the image is developed and transferred so that the color development and transfer is sequential to the intermediate transfer surface. The transfer to the final receiving paper substrate is then a sequential superimposition of all of the individually developed colors.

The inherent advantages of this type of a system lie in the higher resolution obtained from the transfer of the image from the master to the intermediate transfer surface 10 across the liquid-filled gap and there is no nonpolar insulating solvent, such as ISOPAR transferred to the paper.

This electrostatic transfer of the image across the liquid-filled gap between the master 34 and the intermediate transfer surface 45 achieves high resolution because of the transfer being to a conductive receiving surface. It is theorized that the conductive receiving surface pulls all of the field lines from the charged and toned electrostatic image perpendicular to the image's surface, thereby greatly reducing the divergence of the field lines. The conductive surface also creates equal and opposite image charges to the toner's within its surface which is theorized to overwhelm the toner's mutual repulsion charges because of their much closer proximity.

The heating of the conductive intermediate transfer surface 10, because of the excellent thermal release characteristics of the material, facilitates the contact transfer and reduces the need for pressure. The substrate or belt onto which the conductive intermediate transfer surface is applied is dimensionally stable under heat and tension. The volume resistivity of a conductive fluorosilicone fluoroelastomer is from about 10 ohm-centimeters to about $10^6$ ohm-centimeters. The conductive fluorosilicone fluoroelastomer with an initial thickness of about 0.005 inches, when exposed during immersion swell testing to the non-polar insulating solvent, experiences controlled swelling of about 0.003 inches after extended exposure times of greater than 10 minutes. During the printing process of the present invention, however, the conductive fluorosilicone fluoroelastomer intermediate transfer surface is exposed to the non-polar insulating solvent for a maximum of about 2 seconds per image cycle before removal, so swelling is not experienced. When the conductive intermediate transfer surface is employed in a color proofing system, the controlled swelling enables the system to adjust for it by utilizing a compensating gap spacing arrangement.

In order to exemplify the results obtained with the use of the aforedescribed conductive fluoroelastomer intermediate transfer surface, the following examples are provided of the preparation and use of the conductive intermediate transfer surface without any intent to limit the scope of the instant invention to the specific discussion therein.

EXAMPLE 1

An approximately 6 foot long and 2 foot wide laminate substrate comprising a 0.00035 inch (0.35 mil) thick aluminum layer with an underlaying 0.010 inch (10 mil) thick polyester layer was coated on the aluminum surface with a thin layer of about 0.002 inch (2 mil) thick conductive fluorosilicone fluoroelastomer by spraying with a Sharpe Manufacturing Company Model 775PI spray gun fluorosilicone through a 10–70 nozzle. The conductive fluorosilicone layer consisted of a Dow Corning No. 94-003 dispersion coating which was supplied as a mixture of 40% fluorosilicone solids dispersed in methylethyl ketone. The dispersion coating was further reduced to about 16% solids in order to use the coating in a spray gun. This 16% solids included about a 5% carbon black loading of Akzo Chemical's EC300 Ketjen black carbon black. The coating was then cured for about 24 hours at about 25° C. and about 50% relative humidity. The cured coated surface was not completely smooth.

Four photopolymer masters, one for each color, of DuPont Riston 215 dry film photoresist were laminated to a conductive substrate and exposed for about 40 seconds at about 355 millijoules/centimeter$^2$ on an Optibeam Model 5050 exposure unit manufactured by Optical Radiation Corporation. The four master color separations were from a Kodak 4 color test pattern.

The four exposed master color separation images were developed sequentially in separate steps with black, cyan, magenta and yellow color liquid toners. All four images were separately superimposed sequentially through an Isopar® filled gap of about 5 mils to the conductive fluorosilicone fluoroelastomer belt. An air gun blowing at ambient air temperature was used until the Isopar solvent was removed from the belt. The belt was heated by passing at a speed of about 1 inch per second through the nip of a pair of fuser rollers which were heated to a temperature of about 135° C. with a receiving substrate of paper lying in opposition over the belt. The nip between the fuser rollers was about a ¼ inch.

About 80% of all of the toner on the belt transferred to the receiving paper substrate. In some areas where the belt was smooth 100% of the toner was transferred. The image that did transfer was of high quality and demonstrated the feasibility of the process.

EXAMPLE 2

A 24 inch×24 inch laminate substrate comprising a 0.001 inch (1 mil) thick aluminum layer with an underlaying 0.010 inch (10 mils) thick polyester layer was prepared for coating by cleaning and degreasing with a chlorinated solvent. The aluminum surface was rinsed of all cleaning agents with methylethyl ketone and, after drying, a thin coating of Dow Corning 3-6060 prime coat was applied and air dried. The conductive fluorosilicone fluoroelastomer coating was prepared as described with reference to Table 1 previously and was coated on the aluminum surface by pouring onto the the aluminum surface of the substrate and smoothing with a knife to form a coating having a thickness of about 50 mils. The intermediate conductive fluorosilicone fluoroelastomer layer was dried in an oven at about 107° C. for about one hour and then cured at a room temperature of about 25° C. for five days. The layer had a thickness of about 0.005 inches (5 mils).

The photopolymer masters of the same composition as was used in Example I were exposed with four color separation negatives from a No. 7190 GATF Sheetfed Color Printing Test Kit available from the Graphic Arts Technical Foundation of Pittsburgh, Pa. The four color separation negatives had been previously cut to size and held in registration. The masters were developed, and the developed images transferred as described in Example I. 100% of the toner on the intermediate transfer surface was transferred to the receiving paper substrate to form a high quality image.

It is to be understood that alternate methods, besides air spraying or knife-coating can be employed to place a thin, smooth coating of conductive fluoroelastomer onto a conductive substrate, such as copper, silver paste, or aluminum. These include silk screening, draw barring, roller coating, curtain coating, electrostatic spraying or electrophoretic application. Where silver paste is employed as the conductive substrate, a thin coating is obtained by the use of a mesh screen. The conductive surface of the laminate can be coated with a primer, such as the Dow Corning 3-6060 prime coat previously mentioned, prior to the application of the conductive fluoroelastomer.

While the invention has been described above with references to specific embodiments thereof, it is apparent that many changes, modifications and variations in the materials, arrangements of ports and steps can be made without departing from the inventive concept disclosed herein. For example, in employing the improved intermediate transfer surface of the present invention, the receiving surface to which the developed image is contact transferred from the intermediate conductive transfer surface may be either conductive, such as metal, or nonconductive, such as paper or plastic. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A conductive transfer surface for use in electrostatic image transfer comprising, in combination:

(a) a supporting substrate; and (b) a fluoropolymer layer having a dispersion of conductive material therein supported by and in contact with the supporting substrate, the conductive material being fibers or particles each less than about 5 microns in size.

2. The conductive transfer surface of claim 1 wherein the supporting substrate comprises a conductive metal layer underlying and supporting the fluoropolymer layer.

3. The conductive transfer surface of claim 2 wherein the supporting substrate further comprises a second supporting substrate layer underlying and supporting the conductive metal layer, the second supporting substrate being dielectric.

4. The conductive transfer surface of claim 1 wherein the dispersion of conductive material in the fluoropolymer layer is selected from the group consisting of carbon black particles, metal fibers, graphite and metallic powder particles.

5. The conductive transfer surface of claim 4 wherein the carbon black particles are highly structured.

6. The conductive transfer surface of claim 5 wherein the carbon black particles are dispersed in size from about 13 to about 75 millimicrons.

7. The conductive transfer surface of claim 5 wherein the volume resistivity of the fluoropolymer layer is between about $10^{-1}$ to about $10^{6}$ ohm-centimeters.

8. The conductive transfer surface of claim 3 wherein the second supporting dielectric substrate is selected from the group consisting of polyester, polysulfone, polyimide and polyethylene terephthalate.

9. The conductive transfer surface of claim 8 wherein the thickness of the conductive fluoropolymer layer is from about 0.002 to about 0.010 inches.

10. The conductive transfer surface of claim 9 wherein the thickness of the conductive metal layer is from about 0.0001 to about 0.001 inches.

11. The conductive transfer surface of claim 10 wherein the thickness of the second supporting dielectric layer is from about 0.003 to about 0.015 inches.

12. The conductive transfer surface of claim 7 wherein the fluoropolymer layer is a fluoroelastomer selected from the group consisting of fluorosilicones and fluorocarbons.

13. The conductive transfer surface of claim 12 wherein the fluorosilicone layer is selected from the group consisting of a one component fluorosilicone rubber dispersion and a two-component fluorosilicone rubber dispersion.

14. The conductive transfer surface of claim 12 wherein the fluorocarbon layer is one selected from the group consisting of a copolymer of tetrafluoroethylene and propylene; a copolymer of hexafluoropropylene and vinylidene fluoride; a dipolymer of hexafluoropropylene and vinylidene fluoride; terpolymers of hexafluoropropylene, vinylidene fluoride and tetrafluoroethylene; and polytetrafluoroethylene.

15. The conductive transfer surface of claim 8 where the conductive metal layer further comprises aluminum or copper.

16. The conductive transfer surface of claim 6 wherein the carbon black particles comprise from about ½ to about 50% by weight of the conductive fluoropolymer layer.

17. The conductive transfer surface of claim 6 wherein the carbon black particles comprise from about 2 to about 15% by weight of the conductive fluoropolymer layer.

18. The conductive transfer surface of claim 6 wherein the carbon black particles comprise from about 3 to about 6% by weight of the conductive fluoropolymer layer.

19. A method of xeroprinting a color image onto a receiving substrate comprising the steps of:

(a) forming a conductive intermediate transfer surface having conductive fibers or particles each less than about 5 microns in size dispersed therein;

(b) imaging an electrostatically imagable surface to create a master with a latent image thereon;

(c) developing the latent image with a liquid color toner;

(d) electrostatically transferring the developed image across a liquid-filled gap to the conductive intermediate transfer surface, the conductive intermediate transfer surface further being a conductive fluorocarbon selected from the group consisting of a copolymer of tetrafluoroethylene and propylene; a copolymer of hexafluoropropylene and vinylidene fluoride; a dipolymer of hexafluoropropylene and vinylidene fluoride; terpolymers of hexafluoropropylene, vinylidene fluoride and tetrafluoroethylene; and polytetrafluoroethylene;

(e) heating the conductive intermediate transfer surface; and (f) transferring the developed image to a receiving surface by contact transfer.

20. The method according to claim 19 further comprising repeating steps (a–c) a plurality of times until a full color image is formed on the intermediate transfer surface.

21. The method according to claim 20 further comprising substantially removing non-polar insulating solvent surrounding the transferred developed image.

22. The method according to claim 20 further comprising superimposing each liquid color toner on the developed image, substantially drying the superimposed developed image and transferring the superimposed substantially dried developed image to the receiving surface.

23. The method according to claim 20 further comprising heating the receiving substrate.

24. The method according to claim 20 further comprising separately for each color toner repeating steps (a–c) and sequentially transferring separately the developed images to a matching number of conductive intermediate transfer surfaces and then sequentially contact transferring from the matching number of conductive intermediate transfer surfaces and superimposing the substantially dried developed color images to the receiving surface.

25. A conductive transfer surface of ruse in electrostatic image transfer comprising, in combination:

(a) a supporting substrate; and (b) a fluoropolymer layer having a dispersion of highly structured conductive carbon black particles therein supported by and in contact with the supporting substrate, the carbon black particles ranging in size from about 13 to about 75 millimicrons.

26. A method of xeroprinting a color image onto a receiving substrate comprising the steps of:

(a) forming a conductive intermediate fluorocarbon transfer surface having conductive fibers or particles each less than about 5 microns in size dispersed therein;

(b) electrostatically transferring a developed image across a liquid-filled gap to the conductive intermediate fluorocarbon transfer surface, the conductive fluorocarbon being selected from the group consisting of a copolymer of tetrafluoroethylene and propylene; a copolymer of hexafluoropropylene and vinylidene fluoride; a dipolymer of hexafluoropropylene and vinylidene fluoride; terpolymers of hexafluoropropylene, vinylidene fluoride and tetrafluoroethylene; and polytetrafluoroethylene;

(c) heating the conductive intermediate fluorocarbon transfer surface; and (d) transferring the developed image to a receiving surface by contact transfer.

27. Apparatus for color printing a developed image on a final receiving surface, comprising in combination:

(a) means for electrostatically imaging an electrostatically imagable surface to create a latent image thereon;

(b) means for developing the latent image with a liquid color toner;

(c) a conductive intermediate fluoropolymer transfer surface cooperative with the electrostatically imagable surface and the final receiving surface, the conductive intermediate fluoropolymer transfer surface having conductive fibers or particles each less than about 5 microns in size dispersed therein;

(d) means for transferring the developed image across a liquid-filled gap between the electrostatically imagable surface and the conductive intermediate fluoropolymer transfer surface;

(e) means for heating the conductive intermediate fluoropolymer transfer surface; and (f) means for transferring the developed image form the conductive intermediate fluoropolymer transfer surface by contact transfer to a final receiving surface.

28. The apparatus according to claim 27 wherein the conductive intermediate fluoropolymer transfer surface comprises polytetrafluoroethylene.

29. The apparatus according to claim 27 wherein the conductive intermediate fluoropolymer transfer surface comprises a conductive fluoroelastomer.

30. The apparatus according to claim 29 wherein the conductive fluoroelastomer is selected from the group consisting of conductive fluorosilicones and conductive fluorocarbons.

31. The apparatus according to claim 30 wherein the conductive fluorosilicones are selected from the group consisting of one component fluorosilicone rubber dispersions and two component fluorosilicone rubber dispersion.

32. The apparatus according to claim 27 further comprising the conductive intermediate fluoropolymer transfer surface being a conductive fluorocarbon being selected from the group consisting of copolymer of tetrafluoroethylene and propylene; a copolymer of hexafluoropropylene and vinylidene fluoride; a dipolymer of hexafluoropropylene and vinylidene fluoride; and terpolymers of hexafluoropropylene, vinylidene fluoride and tetrafluoroethylene.

* * * * *